US005868248A

United States Patent [19]

Joh

[11] Patent Number: 5,868,248

[45] **Date of Patent: *Feb. 9, 1999**

[54] GOLF CLUB DIVIDER ASSEMBLY FOR USE WITH A GOLF BAG HAVING INDIVIDUALLY ADJUSTABLE CLUB HEAD COVERING MEMBERS

[76] Inventor: William K. Joh, 6852 Vachon Dr., Bloomfield Hills, Mich. 48301

[ * ] Notice: The term of this patent shall not extend beyond the expiration date of Pat. No. 5,613,603.

[21] Appl. No.: 780,673

[22] Filed: Jan. 8, 1997

Related U.S. Application Data

[63] Continuation-in-part of Ser. No. 694,989, Aug. 9, 1996, which is a continuation-in-part of Ser. No. 585,400, Jan. 11, 1996, Pat. No. 5,613,603.

[51] Int. Cl.[6] ..... A63B 55/00

[52] U.S. Cl. ..... 206/315.6; 206/315.2; 206/315.4; 150/160

[58] Field of Search ..... 150/159, 160; 206/315.2–315.6

[56] References Cited

U.S. PATENT DOCUMENTS

| | | | |
|---|---|---|---|
| 1,227,657 | 5/1917 | Pierce | 206/315.6 |
| 1,696,062 | 12/1928 | Thurlow et al. | 206/315.7 X |
| 2,128,546 | 8/1938 | Venmore | 150/160 X |
| 2,752,973 | 7/1956 | Stamp | 206/315.6 |
| 2,925,840 | 2/1960 | Hird | 150/160 X |
| 3,253,627 | 5/1966 | Koetting | 150/160 |
| 3,664,399 | 5/1972 | Neff | 150/160 |
| 3,667,078 | 6/1972 | Distasio | 206/315.4 X |
| 3,842,876 | 10/1974 | Cristelli | 206/315.6 X |
| 3,967,667 | 7/1976 | Robinson | 206/315.6 |
| 4,311,178 | 1/1982 | Kennedy | 206/315.6 |
| 4,932,523 | 6/1990 | Yamazoe | 206/315.4 X |
| 5,099,990 | 3/1992 | Antonious | 206/315.6 |
| 5,103,974 | 4/1992 | Antonious | 206/315.6 |
| 5,226,533 | 7/1993 | Antonious | 206/315.6 |
| 5,279,414 | 1/1994 | Brasher | 206/315.6 |
| 5,345,987 | 9/1994 | Hagar | 150/160 |
| 5,447,228 | 9/1995 | Hodgson, III | 206/315.3 |
| 5,465,840 | 11/1995 | Joh | 206/315.6 |
| 5,505,300 | 4/1996 | Joh | 206/315.6 |
| 5,613,603 | 3/1997 | Joh | 206/315.6 |

FOREIGN PATENT DOCUMENTS

| | | | |
|---|---|---|---|
| 2130102 | 5/1984 | United Kingdom | 206/315.6 |

*Primary Examiner*—Sue A. Weaver
*Attorney, Agent, or Firm*—Gifford, Krass, Groh, Sprinkle, Patmore, Anderson & Citkowski, P.C.

[57] ABSTRACT

A golf club divider assembly for use with a golf bag creates a desired plurality of subdivided and axially extending compartments for receiving a plurality of golf clubs. A plurality of elongated divider members are inserted axially within the golf bag and each divider member includes a plurality of either three or four outwardly and axially extending vane portions. A like plurality of sleeve members may be slidably engaged over the divider members to facilitate the creation of the individual club carrying compartments. Axially repositionable golf club head covering assemblies are provided and are secured to upper ends of the divider members in association with each of the club carrying compartments. The covering assemblies are repositionable in a vertical manner to cover an upwardly projecting club head of a golf club and to isolate and protect the golf club from the remaining golf clubs. Vertical repositionability of the club head cover further enables significantly less encumbered access to the clubs both in and out of the club receiving compartment.

7 Claims, 2 Drawing Sheets

GOLF CLUB DIVIDER ASSEMBLY FOR USE WITH A GOLF BAG HAVING INDIVIDUALLY ADJUSTABLE CLUB HEAD COVERING MEMBERS

CROSS-RELATION TO COPENDING APPLICATIONS

The present application is a continuation-in-part of U.S. Ser. No. 08/694,989, filed Aug. 9, 1996 for a Golf Club Divider Assembly which is in turn a continuation-in-part of U.S. Ser. No. 08/585,400, filed Jan. 11, 1996, U.S. Pat. No. 5,613,603.

BACKGROUND OF THE INVENTION

1. Field of the Invention

The present invention relates generally to a golf club divider which incorporate vertically movable club head covers individually enabling not only to adjust for differing heights of clubs but also to provide less encumbered access to clubs by repositioning the head covering portions, thus freeing the club heads from surrounding head covers.

2. Description of the Prior Art

Golf club divider assemblies which are either integrally formed within a golf bag or are provided as attachment inserts to the golf bag are fairly well known in the art. The purpose of such divider assemblies in all instances is to conveniently isolate the various golf clubs carried within the bag in an efficient and protective manner.

Copending application U.S. Ser. No. 08/585,400, filed Jan. 11, 1996 discloses a golf club divider assembly for use with a golf bag which includes a plurality of interiorly hollow sleeve shaped subdividing members which are placed within a golf bag. Within each of the sleeve shaped members is axially inserted an elongated subdividing having a plurality of radially extending vane portions which, upon insertion, creates a plurality of individual golf club shaft receiving cavities. With specific reference to FIG. 5 of the '400 application, club head covering means are fixedly secured in an upwardly extending manner from the divider members. With further reference to FIG. 6, planar shaped rigid portions may be slidably secured to vertically extending cord members in a friction fit manner so that the portions may be translatably moved between upper and lower positions along the vertical lengths of the cords to protect club heads of varying heights.

Copending application U.S. Ser. No. 08/694,989, filed Aug. 9, 1996, discloses a golf club divider assembly for use with a golf bag which includes a primary club divider member constructed of a plurality of axially directed vane portions and which subdivides the bag into a first plurality of subdivided cavities. One or more secondary club divider members each include additional vane portions and are insertable separately into the respective first subdivided cavities to form individual club receiving cavities. The overall divider assembly when viewed in cross-section resembles a grid-shaped pattern and VELCRO-supported club head covering members are attached to upper ends of the individual club receiving cavities for individually protecting the upwardly projecting golf club heads.

Finally, U.S. Pat. No. 5,103,974, issued to Antonius, teaches an adjustable golf club holder insert for a golf bag which includes a primary central component formed of telescoping members vertically adjustable with respect to each other so as to accommodate larger clubs (woods) carried within the central component. Additional outwardly radially extending portions or additional peripheral sleeve members may be arranged around the primary central component to accommodate additional smaller clubs. The primary disadvantage of the Antonius device is that it does not provide any form of adjustable head covering means for specifically protecting the head portions of the golf clubs and, primarily, the heads of the golf clubs in an individual manner.

SUMMARY OF THE PRESENT INVENTION

The present invention is a golf club divider assembly for use with a golf bag, the golf bag including a body with a hollow interior defined by a bottom and an open top and which is capable of holding a plurality of golf clubs. One or more elongated divider members are provided and each include a plurality of outwardly projecting and axially extending vane portions which, upon slidably inserting the divider member or members into the golf bag enclosure, create one or more pluralities of individual axially extending club receiving compartments.

Individual golf club head covering assemblies are provided which extend upwardly from the one or more divider members and which include at club head covering portions at their uppermost ends. The covering portions are capable of being axially readjusted relative to the divider members in order to provide isolated support to an individual golf club and particularly the club head at any height. According to one preferred embodiment, the covering portions are secured to individual stem portions which are in turn mounted within elongated channels formed in the divider members in proximity to the individual club receiving cavities and which are axially slidable in a vertical direction in a slight friction fit manner in order to reposition the covering portions around the club heads.

In a further preferred embodiment, opposite ends of the covering portions are attached to planar shaped inserting members which in turn are received between vertically extending slots running the length of opposing vane faces. The edges of the planar shaped inserting members are received within the slotted portions extending along the vane faces in a likewise slight friction fit manner to permit vertical readjustment in order to position the covering member at the appropriate height relative to the associated club head.

According to additional preferred embodiments, a plurality of three to four individual divider members are provided for axial insertion within the golf bag and each includes between three and four vane portions for the creation of three to four individual club carrying compartments apiece. Outer sleeve members are provided within which the divider members are inserted for the purpose of isolating the individual compartments of more than one divider member from one another. According to a yet further embodiment, the sleeve members and divider members are formed as an integral one piece extrusion. The vertical axial mobility of the stem portions allows the user to manually move the head cover both high above or below the club head, thus freeing club heads from enclosing obstruction of the head cover and allows easier access to clubs both in an out of the compartment.

BRIEF DESCRIPTION OF THE DRAWINGS

Reference will now be had to the attached drawings, when read in combination with the following specification, wherein like reference numerals refer to like parts throughout the several views, and in which.

DESCRIPTION OF THE PREFERRED EMBODIMENTS

Figure 1:
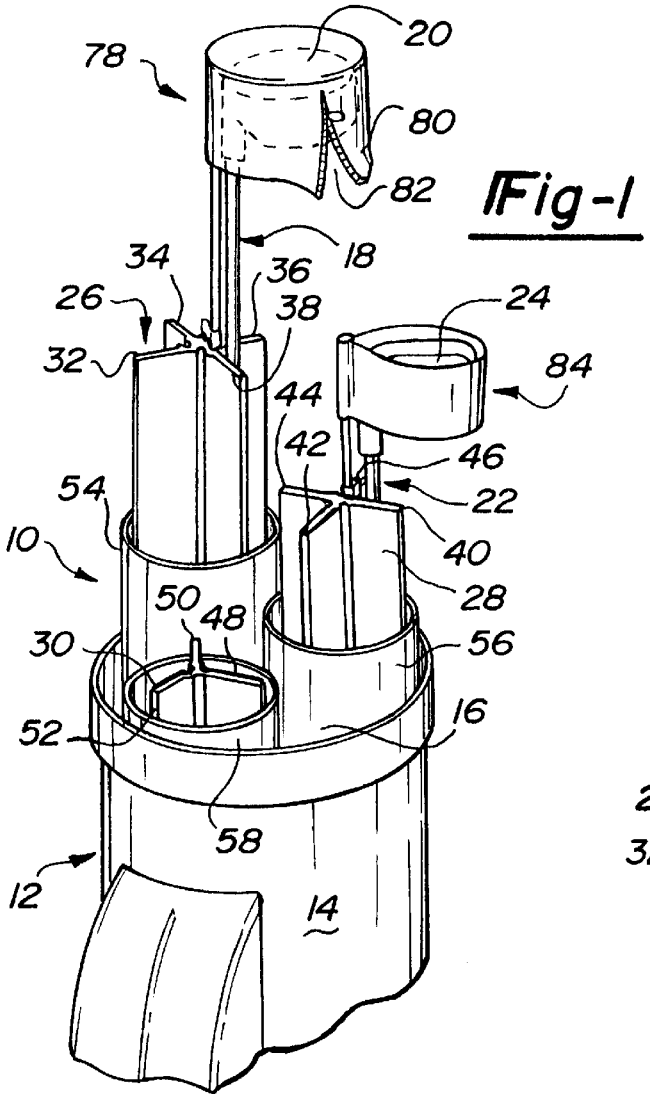
FIG. 1 is a perspective view, with the golf bag shown in partial section, of the golf club divider assembly according to the present invention.

Referring now to FIG. 1, a golf club divider assembly 10 is shown for use with a golf bag 12 according to a first preferred embodiment of the present invention. The golf bag 12 is preferably of a design known in the art and includes a body 14 with a flexible outer covering and having a cross sectional shape such as is illustrated, a bottom (not shown) and an open top 16. The bag is suitable for carrying a set of golf clubs, illustrated by golf club 18 with an extending shaft and terminating in club head 20 and golf club 22 terminating in club head 24.

The divider assembly includes a plurality of individual elongated divider members, illustrated as a first divider member 26, a second divider member 28 and a third divider member 30. The divider members 26, 28 and 30 may all be of the same axial height or different heights as is shown in FIG. 1 and are preferably constructed of a lightweight metal or durable plastic or other material exhibiting the necessary characteristics of rigidity and impact resistance.

Each divider member 26, 28 and 30 further includes a plurality of outwardly projecting and axially lengthwise extending vane portions. Specifically, first divider member 26 includes outwardly projecting vane portions 32, 34, 36 and 38 second divider member 28 includes outwardly projecting vane portions 40, 42, 44 and 46 and third divider member 30 includes outwardly projecting vane portions 48, 50 and 52. A first sleeve member 54, a second sleeve member 56 and a third sleeve member 58 are provided for receiving the first, second and third divider members 26, 28 and 30, respectively in an axially insertable manner in order to create pluralities of individual and axially extending club receiving compartments for receiving associated shaft portions of inserted golf clubs. The number of club receiving compartments created is determined by the given plurality of vane portions extending from an associated divider member and, in the case of the first divider member 26 and second divider member 28, four vane portions are employed to create four individual club receiving compartments, whereas the third divider member 30 utilizes only three such vane portions for the creation of three club receiving compartments. Furthermore, while the three divider members 26, 28 and 30 are illustrated in FIG. 1, it is also understood that either fewer or more than three divider members, such as two, four, etc., may be utilized according to the present invention without departing from its intended scope.

Figure 2:
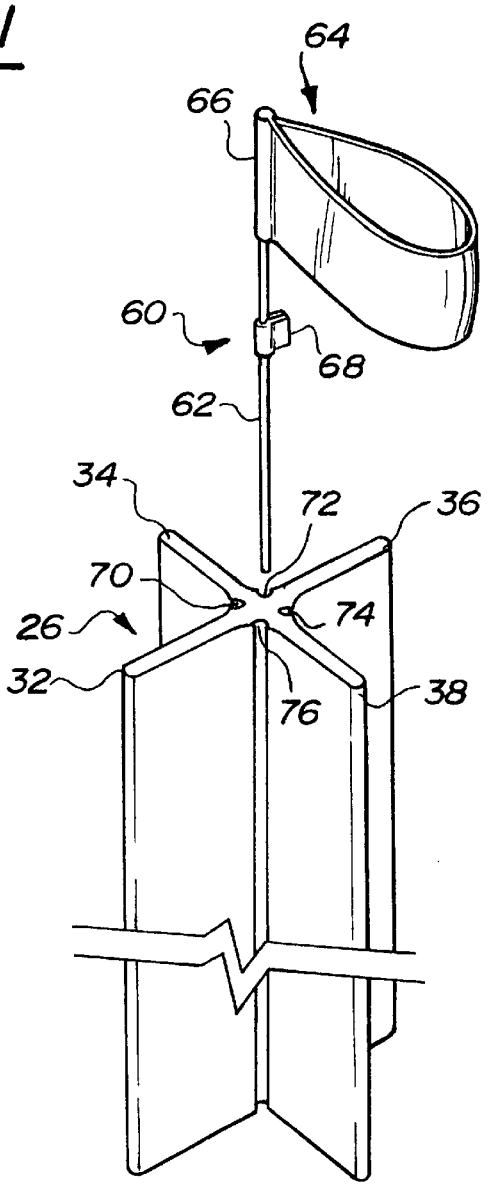
FIG. 2 is a sectional view of an individual divider member with axially repositionable club head covering assembly according to the present invention.

Referring now to FIG. 2, an expanded view of any of the divider members 26, 28 and 30, is shown, but is illustrated as the first divider member 26 in sectional and reduced length view and better illustrates the individual and repositionable club head covering assemblies according to the present invention. Specifically, a covering assembly 60 according to the first preferred embodiment includes an elongated stem portion 62 which terminates at an upper end in a covering portion 64 which in turn is constructed of a flexible material creating an enclosed loop and mounting to the stem portion 62 by an sleeve-like receiving portion 66. A stop portion 68 is mounted at an intermediate location along the stem portion 62 and permits to maintain predetermined height of covering portion when the stem portion is axially slidably inserted within one of a plurality of individual associated elongated channels formed within the first divider member 26 in proximity to the club receiving compartments created by the vane portions 32, 34, 36 and 38. Specifically, channels 70, 72, 74 and 76 extend in a vertically and partially inwardly spaced manner relative to the junction points established between succeeding vane portions 32 to 34, 34 to 36, 36 to 38 and 38 to 32, respectively.

While only the covering assembly 60 is illustrating in FIG. 2, it is understood that four such covering assemblies are employed with an associated stem portion from each (represented by stem portion 62) being slidably inserted within the associated channel utilizing a combination of either or both in a slight friction fit and/or the covering portion 64 to reposition vertically the covering member at an ideal height to surround and isolate an associated club head. The stop portion 68 may further be readjusted along the vertical length of the stem portion 62 to redefine the height of the covering portion 64 to take into account club heads at differing overall heights. The length of the stem portion is sufficiently long enough to prevent accidental dislocation of the stem from the elongated channel.

Figure 3:
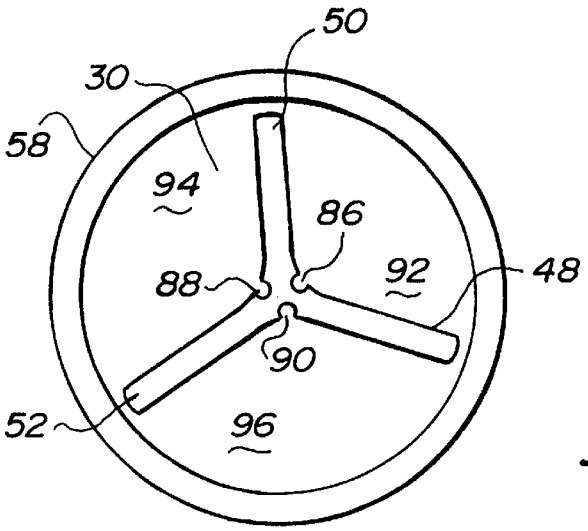
FIG. 3 is an end view of a selected divider member of the golf club divider assembly as shown in FIGS. 1 and 2 and further illustrating the axial sliding insertion of the divider member within an associated sleeve member.

Referring again to FIG. 1, a covering assembly 78 displays a covering portion 80 which is zippered, at 82, in a further preferred variant in order to conveniently surround the club head 20. Covering assembly 84 is further provided substantially as disclosed as assembly 60 in FIG. 2 and is received within the selected elongated channel of second divider member 28 to provide isolating and protective support to upwardly projecting club head 24. FIG. 3 further illustrates additional inwardly spaced and axially extending elongated channels 86, 88 and 90 associated with individual club receiving compartments 92, 94 and 96 formed between the third divider member 30 and associated sleeve member 58. Also, either covering assemblies 64 or 78 can be interchangeable with any divider member.

Figure 4:
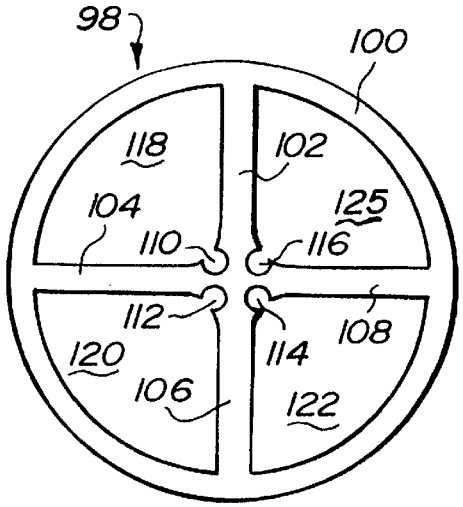
FIG. 4 is an end view similar to that illustrated in FIG. 3 and showing an integral one-piece divider and sleeve according to a further preferred embodiment of the present invention.

Referring now to FIG. 4, a modification 98 of the divider assembly illustrated in FIG. 3 is shown in end view and includes an elongated one-piece extrusion member which is constructed of a closed outer circular portion 100 and four vane portions 102, 104, 106 and 108 which secured to associated inner faces of the closed outer circular portion 100 and extend inwardly as substantially webbed portions. The four vane portions 102, 104, 106 and 108 meet in a generally central location such that partially inwardly recessed and elongated channels 110, 112, 114 and 116 are formed at junction points established between succeeding vane portions 102 to 104, 104 to 106, 106 to 108 and 108 to 102, respectively. The integral one-piece extrusion disclosed by this embodiment creates individual club receiving compartments 118, 120, 122 and 124, respectively, for separately housing at least four individual golf clubs and further for providing separate club head covering assemblies for each individual club head.

Figure 5:
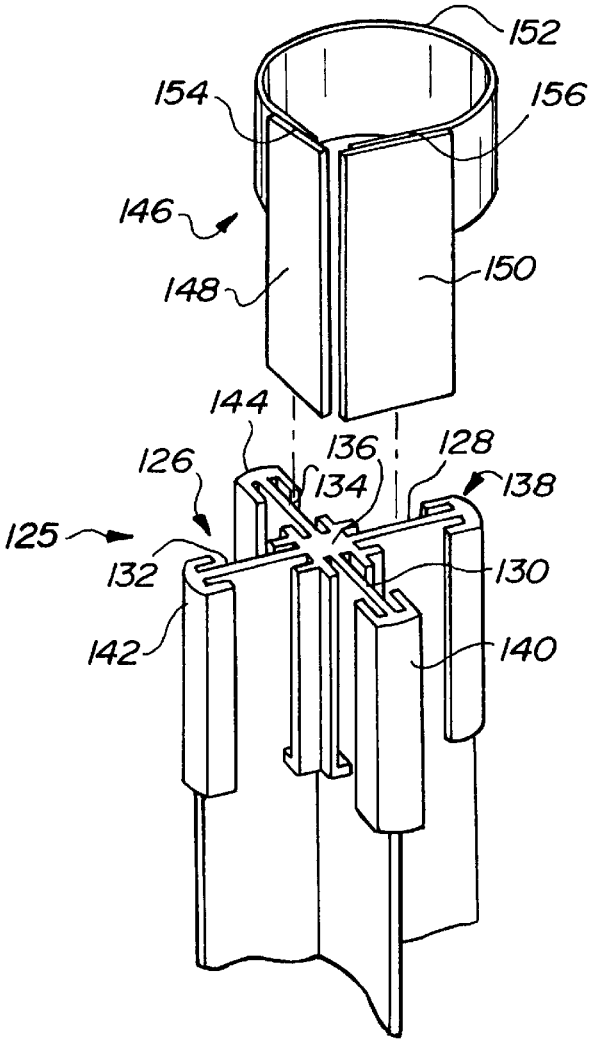
FIG. 5 is a perspective view of a divider member with axially repositionable club head covering assembly according to a further preferred embodiment of the present invention.

Referring now to FIG. 5 a further preferred embodiment of a club divider assembly 125 is shown and includes an elongated divider member 126 having a first radially projecting vane portion 128, a second radially projecting vane portion 130, a third radially projecting vane portion 132 and a fourth radially projecting vane portion 134. As is also better illustrated in the end view of FIG. 6, vertically extending slotted portions are formed along the exterior faces of each of the vane portions 128, 130, 132 and 134 and are provided by first outwardly facing slotted guides extending axially along a base connection 136 of the vane portions and second inwardly facing slotted guides likewise extending axially along outer edges 138, 140, 142 and 144 of the vane portions 128, 130, 132 and 134, respectively.

A club head covering assembly is illustrated at 146 and includes a first planar shaped inserting member 148 and a second planar shaped inserting member 150. A flexible covering portion 152 is provided and secures at a first end 154 to the first planar shaped member 148 and at a second end 156 to the second planar shaped member 150. The planar shaped inserting members 148 and 150 are dimensioned such that their outer edges align with the outwardly and inwardly facing slotted receiving guides and permit the inserting members to be axially inserted along the opposing faces of the vanes.

Figure 6:
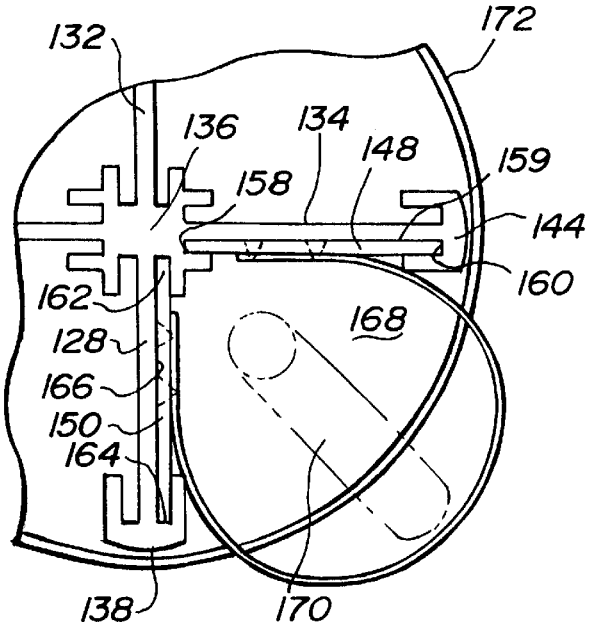
FIG. 6 is an end view in partial of the further preferred embodiment of FIG. 5.

As is best seen in end view fashion from FIG. 6, a first outwardly facing slotted receiving guide 158 extending along a specified face 159 of the vane 134 is arranged in opposing and spaced apart fashion relative to an inwardly facing slotted receiving guide 160 according to a dimension which permits the axial insertion of the planar shaped inserting member 148. Likewise, an additional outwardly facing slotted receiving guide 162 is arranged in opposing and spaced apart fashion relative to an inwardly facing slotted receiving guide 164 associated with a face 166 of the vane 138 which is in opposing fashion to face 159 of vane 134 and which defines a club receiving cavity 168 for club 170. An outer sleeve member 172 (FIG. 6) is provided for creating the individual compartments assuming more than one subdividing member is utilized for a golf bag enclosure.

The inserting members 148 and 150 are each dimensioned to be frictionally engageable within their associated slotted guide members so that the flexible covering members may be located and readjusted to any desired height to surround a golf club head extending from the associated cavity. While only a single covering assembly 146 is illustrated, it is understood that four such assemblies would be employed in the embodiment of FIGS. 5 and 6 and furthermore that divider assemblies displaying differing numbers of vane portions could be utilized. Repositioning of the head covers vertically both upwardly and downwardly by adjusting the height of the planar inserting members allows for the club head to be freed from the surrounding covering enabling free access to the club.

It is therefore evident that the present invention discloses a novel and useful golf club divider assembly for use with a golf bag for providing individual club shaft receiving compartments and adjustable club head protection for accommodating golf clubs of varying lengths permitting easy access to the clubs withdrawn or replaced to or from the compartment by way of the vertically movable club head covering portions. Having described my invention, additional embodiments will become apparent to those skilled in the art to which it pertains without deviating from the scope of the appended claims.

I claim:

1. A golf club divider assembly for use with a golf bag, the golf bag having a body with a hollow interior defined by a bottom and an open top and capable of holding a plurality of golf clubs each including a club shaft and a club head, said divider assembly comprising:

at least one elongated divider member including a plurality of outwardly projecting and axially extending vane portions, said at least one elongated divider member being slidably inserted within the golf bag to subdivide the bag into a plurality of individual axially extending compartments; and individual head covering means secured to said at least one divider member and associated with each of said plurality of axially extending compartments, said head covering means incorporating a club head covering portion which is axially repositionable relative to said divider member, said head covering means further including a zippered portion formed along an edge of said head covering portion;

said head covering means further including a plurality of elongated stem portions, a plurality of close-looped and fabric club head covering portions each having a sleeve-like receiving portion at one end, said sleeve portion mounting over an upper end of said elongated stem portion, a stop portion secured to an intermediate location of each of said plurality of elongated stem portions, said stop portions defining an extent of downwardly translating movement of said stem portions and said club head covering portions relative to said associated divider member; and a plurality of partially inwardly spaced and axially extending elongated channels formed in said at least one divider member at a junction point between succeeding vane portions and in proximity to each of said individual axially extending compartments, said elongated stem portions being mounted axially and slidingly within said elongated channels to permit free vertical motion of said stem and head covering portions away from the club head, thus eliminating an element of obstruction of said head covering portion in the way of the club head to permit easy access to the club both in and out of said club receiving compartment;

said head covering means being axially readjustable to provide isolated club head support to an upwardly projecting club head of a golf club according to any length which is carried within a selected one of said axially extending compartments.

2. The golf club divider assembly according to claim 1, said at least one elongated divider member further comprising a first divider member according to a first predetermined height, a second divider member according to a second predetermined height and a third divider member according to a third predetermined height.

3. The golf club divider assembly according to claim 2, further comprising a first sleeve member within which said first divider member is slidably engaged, a second sleeve member within which said second divider member is slidably engaged and a third sleeve member within which said third divider member is slidably engaged.

4. The golf club divider assembly according to claim 1, said plurality of vane portions of said at least one elongated divider member further comprising a first, a second, a third and a fourth outwardly projecting and axially extending vane portion, a closed circular outer portion being integrally formed with outer ends of said outwardly projecting and axially extending vane portions to create an elongated and extruded one-piece divider member.

5. A golf club divider assembly for use with a golf bag, the golf bag having a body with a hollow interior defined by a bottom and an open top and capable of holding a plurality of golf clubs each including a club shaft and a club head, said divider assembly comprising:

at least one elongated divider member including a plurality of outwardly projecting and axially extending vane portions, said at least one elongated divider member being slidably inserted within the golf bag to subdivide the bag into a plurality of individual axially extending compartments;

individual head covering means secured to said at least one divider member associated with each of said plurality of axially extending compartments, said head covering means incorporating a club head covering portion which is axially repositionable relative to said divider member; and said head covering means further including a first planar shaped member and a second planar shaped member, an elongated and flexible covering portion secured at a first end to said first planar shaped member and at a second end to said second planar shaped member, each of said outwardly projecting and laterally extending vane portions including a first outwardly facing slotted guide at an inner end thereof and a second opposing and inwardly facing slotted guide at an outer end thereof, said first and second planar shaped members being dimensioned so that outer edges thereof are slidably engaged within said inwardly and outwardly slotted guides of succeeding vane portions so as to permit said planar shaped members to be slidably engaged in an axial direction and slight friction fit manner;

said head covering means being axially readjustable to provide isolated club head support to an upwardly projecting club head of a golf club according to any length which is carried within a selected one of said axially extending compartments.

6. The golf club divider assembly according to claim 5, said at least one elongated divider member further comprising a first divider member according to a first predetermined height, a second divider member according to a second predetermined height and a third divider member according to a third predetermined height.

7. The golf club divider assembly according to claim 6, further comprising a first sleeve member within which said first divider member is slidably engaged, a second sleeve member within which said second divider member is slidably engaged and a third sleeve member within which said third divider member is slidably engaged.

* * * * *